US010724818B2

(12) United States Patent
Llewellyn

(10) Patent No.: US 10,724,818 B2
(45) Date of Patent: Jul. 28, 2020

(54) FIREARM SILENCER ASSEMBLY AND METHOD OF USE

(71) Applicant: Perry Turner Llewellyn, Jacksonville, NC (US)

(72) Inventor: Perry Turner Llewellyn, Jacksonville, NC (US)

( * ) Notice: Subject to any disclaimer, the term of this patent is extended or adjusted under 35 U.S.C. 154(b) by 0 days.

(21) Appl. No.: 16/600,173

(22) Filed: Oct. 11, 2019

(65) Prior Publication Data

US 2020/0182579 A1 Jun. 11, 2020

Related U.S. Application Data

(63) Continuation-in-part of application No. 15/343,517, filed on Nov. 4, 2016, now abandoned.

(60) Provisional application No. 62/251,948, filed on Nov. 6, 2015.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/44; F41A 21/325; F41A 21/36; F41A 21/34
See application file for complete search history.

(56) References Cited

U.S. PATENT DOCUMENTS 944,646 A * 12/1909 Xardell ..... F01N 1/089 181/275
2,780,962 A * 2/1957 Ressler ..... F41A 21/30 89/14.2
4,291,610 A * 9/1981 Waiser ..... F41A 21/30 89/14.4
6,425,310 B1 * 7/2002 Champion ..... F41A 21/30 89/14.3
6,575,074 B1 * 6/2003 Gaddini ..... F41A 21/30 89/14.4
7,832,323 B1 * 11/2010 Davies ..... F41A 21/30 89/14.4
8,087,337 B1 * 1/2012 Cary ..... F41A 21/36 89/14.3
8,087,338 B1 * 1/2012 Hines ..... F41A 21/30 181/223
8,499,676 B1 * 8/2013 Moore ..... F41A 21/26 42/90
8,807,272 B2 * 8/2014 Bladen ..... F41A 21/30 181/223
8,875,612 B1 * 11/2014 Klett ..... F41A 21/30 89/14.4
9,102,010 B2 * 8/2015 Wilson ..... F41A 21/30
9,103,618 B2 * 8/2015 Daniel ..... F41A 21/325
9,347,727 B1 * 5/2016 Cler ..... F41A 21/30
(Continued)

FOREIGN PATENT DOCUMENTS

EP 3056852 A1 * 8/2016 ..... F41A 21/30

*Primary Examiner* — Benjamin P Lee
(74) *Attorney, Agent, or Firm* — Stephen M. Kepper; Intellectual Property Consulting, LLC

(57) ABSTRACT

The disclosed invention provides a method and suppressor assembly that allows a suppressor to be used in combination and interchangeably with a blank firing adaptor. The assembly comprises a muzzle mount, an elongate member, an end cap, an outer tube, and an a blank firing adaptor that is configured to be fastened to the front end of the muzzle mount and disposed within the suppressor.

16 Claims, 17 Drawing Sheets

(56) References Cited

U.S. PATENT DOCUMENTS

| | | | | |
|---|---|---|---|---|
| 9,441,901 | B1 * | 9/2016 | Harrison | F41A 21/36 |
| 9,500,427 | B1 * | 11/2016 | Larue | F41A 21/30 |
| 10,228,210 | B2 * | 3/2019 | Parker | F41A 21/30 |
| 2010/0180759 | A1 * | 7/2010 | Petersen | F41A 21/30 89/14.4 |
| 2012/0272818 | A1 * | 11/2012 | Dueck | F41A 21/30 89/14.4 |
| 2013/0319790 | A1 * | 12/2013 | Bladen | F41A 21/30 181/223 |
| 2014/0216237 | A1 * | 8/2014 | Butler | F41A 21/36 89/14.4 |
| 2015/0001001 | A1 * | 1/2015 | Wilson | F41A 21/30 181/223 |
| 2016/0061551 | A1 * | 3/2016 | Petersen | F41A 21/28 89/14.4 |
| 2017/0030672 | A1 * | 2/2017 | Larue | F41A 21/30 |
| 2017/0205175 | A1 * | 7/2017 | Garst | F41A 21/30 |
| 2018/0340749 | A1 * | 11/2018 | Palu | F41A 21/30 |
| 2019/0017769 | A1 * | 1/2019 | Gianelloni, III | F41A 21/34 |

* cited by examiner

FIREARM SILENCER ASSEMBLY AND METHOD OF USE

RELATED APPLICATIONS

This application is a continuation-in-part of U.S. application Ser. No. 15/343,517 filed Nov. 4, 2016, which claims priority to U.S. Provisional Application No. 62/251,948 filed Nov. 6, 2015. The entire contents of the above applications are hereby incorporated by reference as though fully set forth herein.

FIELD

The invention relates to firearms in general and more particularly, to firearm accessories such as silencers or noise suppressors for firearms.

BACKGROUND

Firearms, such as pistols or rifles utilize expanding high pressure gases generated by burning propellant to expel a projectile from the weapon at a relatively high velocity. When the projectile exits the muzzle end of a weapon's barrel a high-pressure pulse of combustion gases and light from burning powder follows. The rapid pressurization and subsequent depressurization caused by the high-pressure pulse gives rise to a loud sound or report.

The use of firearm silencers, e.g., also referred to as noise suppressors, on firearms to reduce the amplitude of their muzzle blast is known. Silencers operate to reduce muzzle blast by reducing and controlling the energy level of propellant gases accompanying the projectile as it leaves the muzzle end of the weapon. These devices typically include an elongated tubular housing containing a sense of baffles within a plurality of successive chambers. These chambers with baffles therein serve to control, delay, and divert the flow, expansion, and exiting of propellant gases, and also to reduce the temperature of the gases, so as to achieve a corresponding reduction in the noise and impulse produced by the propellant gases as they ultimately exit the device. The rear, or proximal end of a silencer typically includes a mechanism for removably attaching the device to a firearm, such as a threaded engagement mechanism allowing the silencer to be attached onto the end of the firearm's muzzle. At the front or distal end there is an opening to allow the projectile travelling through the path in the silencer, to exit when the firearm is discharged. The end is typically located sufficiently forward of the muzzle end of the firearm that it also can effectively function as a muzzle flash suppression device.

A problem with existing silencers is that they all fail to address certain aerodynamics involved when a projectile and accompanying propellant is discharged from a firearm.

Existing silencers do not address the aerodynamics involved with dealing with two different blasts a silencer experience. The first blast is from the stored energy of the air occupying the space between the space between the front of the projectile and the end of the silencer. The second blast is created from ignited propellant that travels behind the projectile. Existing silencers only work to mitigate the blast created by the propellant charge by slowing down or redirecting the gases present and ultimately out of the front of the silencer through the channel the projectile follows. The current invention regulates and redirects both the first blast of gas as well as the muzzle blast created from propellant.

Another problem with existing silencers is that they do not allow for easy transition between use of live projectiles and blank projectiles. Blank firing adaptors are well known in the art. Typically, these adaptors are fastened onto customizable mounting accessories at the discharge end of a firearm and essentially serve as a plug, preventing any material, including accidental live rounds, from being discharged and directed towards an intended target. These mounting accessories are often different from the mounting accessories that are compatible with a suppressor, forcing the user to carry and keep track of multiple pieces of equipment.

Further, in order to allow the firearm to cycle while using a blank firing adaptor, these adaptors require a relief port that allows the pressurized gas flowing through the adaptor to be redirected and expelled in a safe direction. Current suppressors are not configured to be coupled to a blank firing adaptor in a way that allows this pressurized gas to be expelled in a safe direction while simultaneously ensuring the discharge path of the projectile is perfectly sealed and plugged.

In accordance with the invention, the problems involved with current silencers which fail to address handling the two blasts of gases are avoided by the embodiments described herein.

In further accordance with the invention, the problems involved with current silencers not being compatible with blank firing adaptors are addressed by the embodiments disclosed herein.

It is noted that the terms "silencer" and "suppressor" are used interchangeably herein and refer generally to devices attached or attachable to the end of a barrel or muzzle of a firearm, for reducing the sound levels resulting from firing of the firearm.

BRIEF SUMMARY OF THE INVENTION

In accordance with the invention, two blasts occurring when a firearm is discharged are dealt with in an effective way that is not done with existing firearm silencers. More specifically, one embodiment of the invention includes a suppressor assembly having an elongate member connected to a muzzle mount, wherein the elongate member includes an initial expansion chamber proximate to the discharge end of the firearm includes at least one, and preferably multiple, bypass sets of openings leading into respective channels machined into the outside surface of the elongate member of the silencer. The openings allow at least a first blast of gas, which is residual air within the firearm, to pass into the channel and bypass the baffle containing chambers in the elongate member. An outer tube seals the elongate member and chambers contained therein so that the gas from the first blast passes through the openings in the first chamber, into the respective channels to be directed forwardly through the silencer, to the distal end thereof to be discharged through corresponding multiple openings connected to the channels at the distal end of the elongate member. A portion of the gas from the first blast can also pass through the passage for the projectile and out the end of the silencer.

A second blast of air (i.e., propellant gases) resulting from firing the firearm is redirected within the baffle chambers included within an elongate member, due to the physical shape of each baffle, in a transverse direction relative to the path of the projectile, by a multitude of baffle chambers to reduce the energy of the propellant gas flow, and to eliminate or reduce the sound blast that occurs when the firearm is discharged. Some of the gas from the second blast may also exit through the multiple channels which assists in bleeding off residual gas pressure in the firearm. Thus, the first blast passes into the openings of the first chamber and into the channels, and is bled out through openings at the distal end to more effectively deal with the dual blast of air and propellant gases which result from the discharge of a firearm. The propellant gas blast is generally initially contained within the baffle chambers and redirected, after which the gases pass to the atmosphere from the silencer thereby reducing any gas back pressure remaining in the barrel.

In a further embodiment of the invention, the suppressor assembly disclosed includes a blank firing adaptor. The assembly includes a muzzle mount having a base and a front housing extending longitudinally from the base, wherein said base is operable to attach to the barrel of a firearm, and wherein the front housing further includes an open front end, a chamber disposed within the front housing, and a plurality of relief ports in the front housing that communicate with the chamber; an elongate member comprising a top wall and a bottom wall extending from a proximal end of the elongate member to an opposing distal end, each having an outer surface and an inner surface, wherein a plurality of barriers connected to the inner surface of the top and bottom wall define an initial expansion chamber and a plurality of baffle chambers within the elongate member, wherein the initial expansion chamber is operable to receive the front housing of the muzzle mount, wherein the first end of the elongate member is operable to attach to the muzzle mount; an outer tube operable to enclose the elongate member; an end cap, wherein the end cap is operable to attach to the second end of the elongate member, wherein a bore operable to receive a projectile extends longitudinally through the muzzle mount, elongate member, and end cap; and a blank firing adaptor operable to be fastened to the open front end of the muzzle mount.

A further embodiment of this invention describes a method of firing a live or blank projectile from a firearm that includes the embodiments of the suppressor assembly described herein.

DETAILED DESCRIPTION

Figure 1:
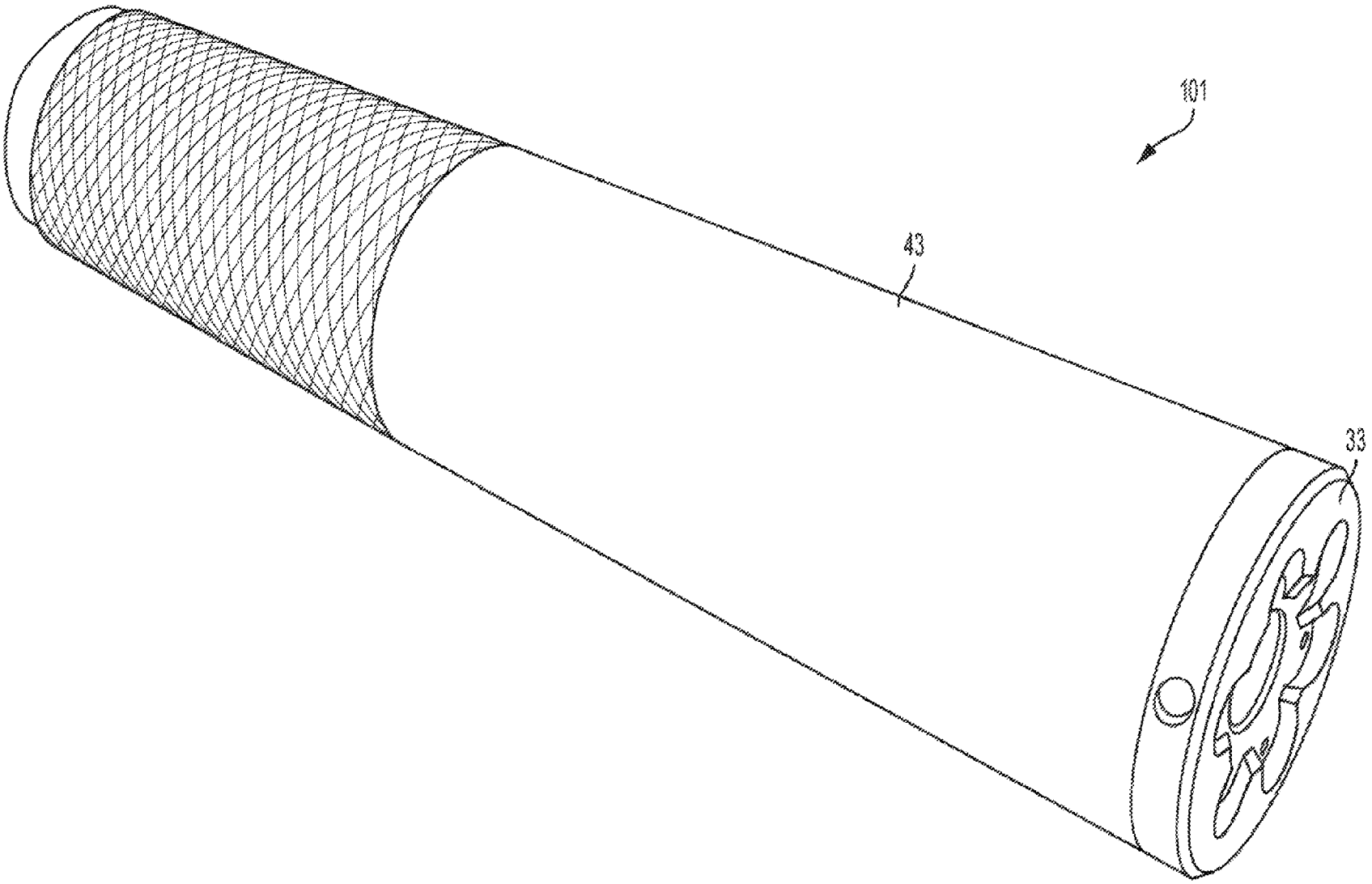
FIG. 1 is a perspective view of an assembled silencer/suppressor in accordance with the invention.

FIG. 1 illustrates an assembled silencer/suppressor 101 in accordance with the invention with an outer tube 43 held thereon by end cap 33.

Figure 2:
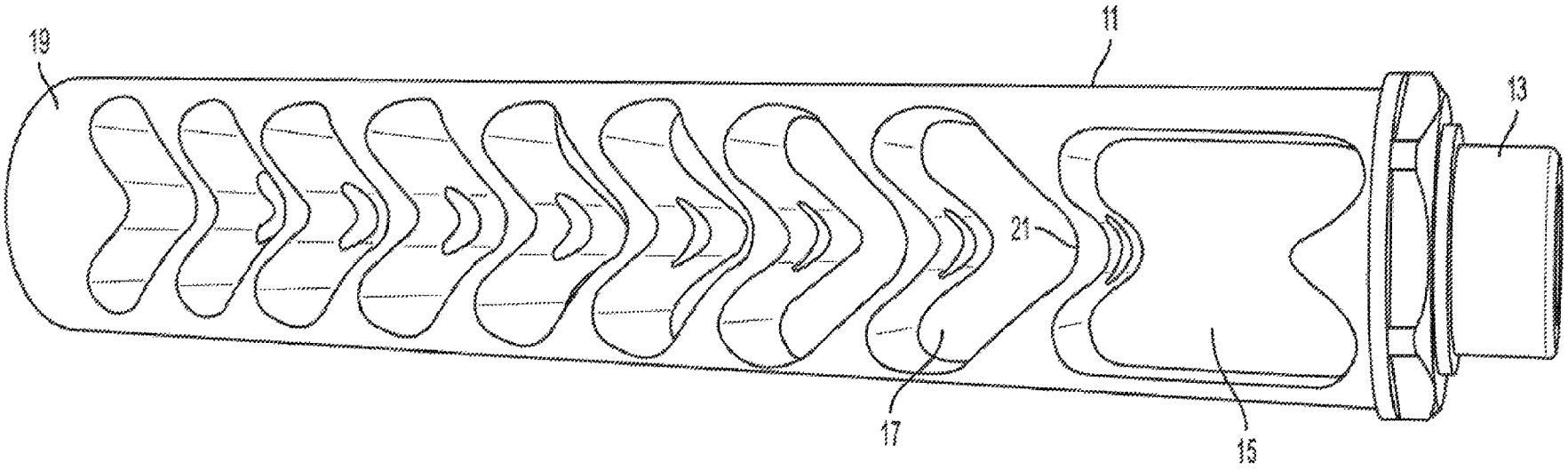
FIG. 2 is a side view of the elongate member of a silencer assembly in accordance with the invention.

FIG. 2 is a side-view of an elongate member 11 of the silencer 101. The silencer 101, including the elongate member 11, has a connector portion 13 for connecting to the end of the barrel of a firearm, for example, by threaded engagement. A distal end 19 is the discharge end of the silencer 101. A central passage 21, also describes as a "bore" in this application, is provided connecting an opening at the connector portion 13 with an opening at the distal end 19 for allowing a projectile to pass through the silencer 101 from the firearm and out from the distal end 19. The central passage 21 passes through and is in connection or association with a series of baffle chambers 17 which follow in sequence from an initial expansion chamber 15 which is located proximate the connection point to the barrel of a firearm. While this embodiment shows progressively smaller baffle chambers 17 approaching the distal end 19, it will be appreciated that the baffle chambers 17 can remain the same size throughout the length of the elongate member 11.

Figure 3:
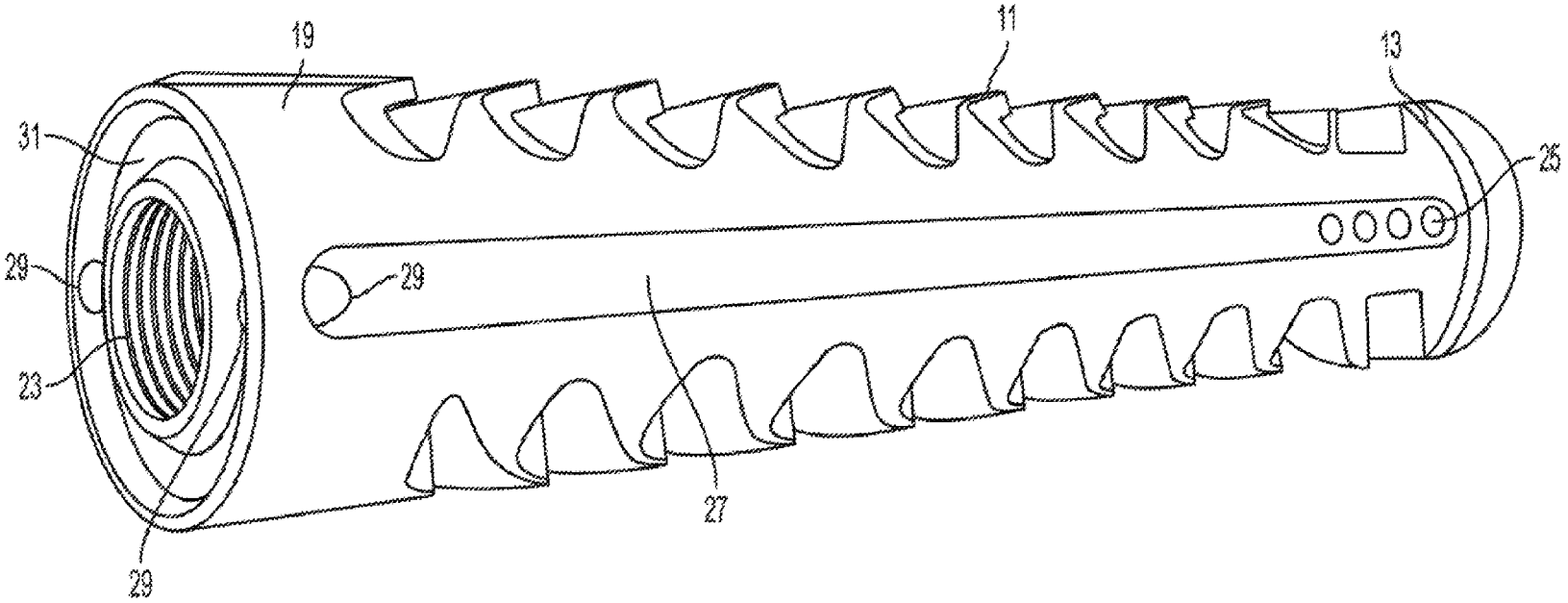
FIG. 3 is a perspective view of the elongate member of the invention.

FIG. 3 is a perspective view of the elongate member 11 of the silencer 101 of the invention. Outlet ports 25 are provided connecting to and outwardly from the initial expansion chamber 15 to allow gases which are, for example, air located within the firearm to pass therethrough as gases from the first blast are moved out of the silencer by passing through the recessed channels 27 machined into the exterior surface of the elongate member 11 to terminate at a wall portion partially defining a recessed region 31 at the distal end 19 of the elongate member 11 adjacent the end. These gases flow within channels 27 since they are sealed by the outer tube 43. Openings 29 at the partial wall 39 (FIG. 6) separating a generally recessed region 31 allow the gases which have been passed through openings 29 through channel 27 to exit the end of the elongate member 11 through an end cap 33, shown in FIG. 4, as will be further explained hereafter. The end cap 33 can be attached through engagement with the threads 23 as will be discussed hereafter.

It will be appreciated that while only two channels 27 are shown, only one or a plurality of channels 27 can be implemented and also serve to pass gases resident in the firearm and silencer and from the propellant blast through the channels 27 as the gases from that blast are diverted back to initial expansion chamber 15 by the baffles. Some of the gases also pass out the bore 21 of the elongate member 11 at the end thereof. What is important to appreciate is that the silencer 101 provides multiple paths for expansion and discharge of gas through the baffle chambers 17, ports 25, channels 27, recessed region 31, and multiple openings 37 of end cap 33.

Figure 4:
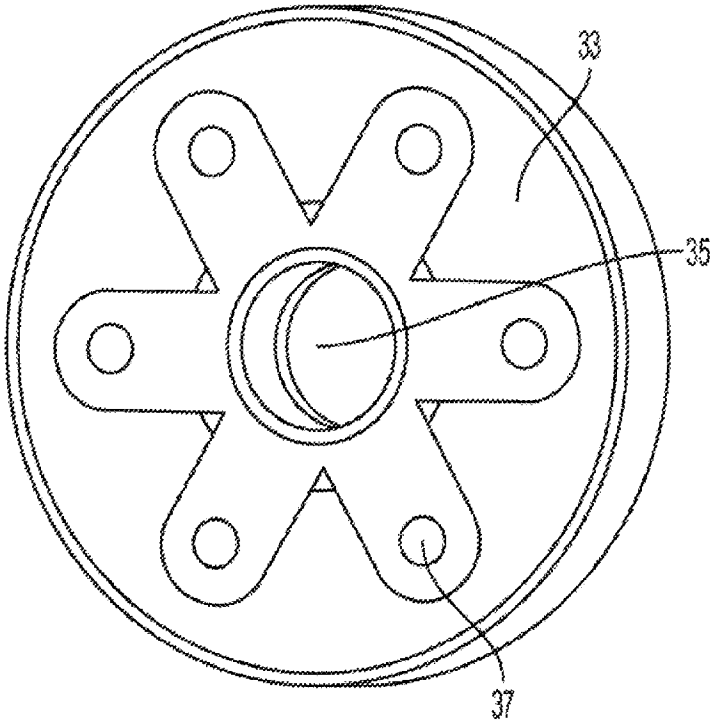
FIG. 4 is a plan view of an end cap of the invention.

FIG. 4 illustrates the end cap 33 for use with the silencer 101 of the invention. The end cap 33 includes a central opening 35 aligned with the central passage or bore 21 of the elongate member so that when the silencer 101 is assembled, a projectile travels through the bore 21 and is discharged from the silencer 101 at the central opening 35. Openings 37 open into the recessed region 31 to allow rapid discharge of gases which were passed and allowed to expand and slow by being received in the recessed region 31. The gases then pass through openings 29 from channels 27 to escape the silencer 101.

Figure 5:
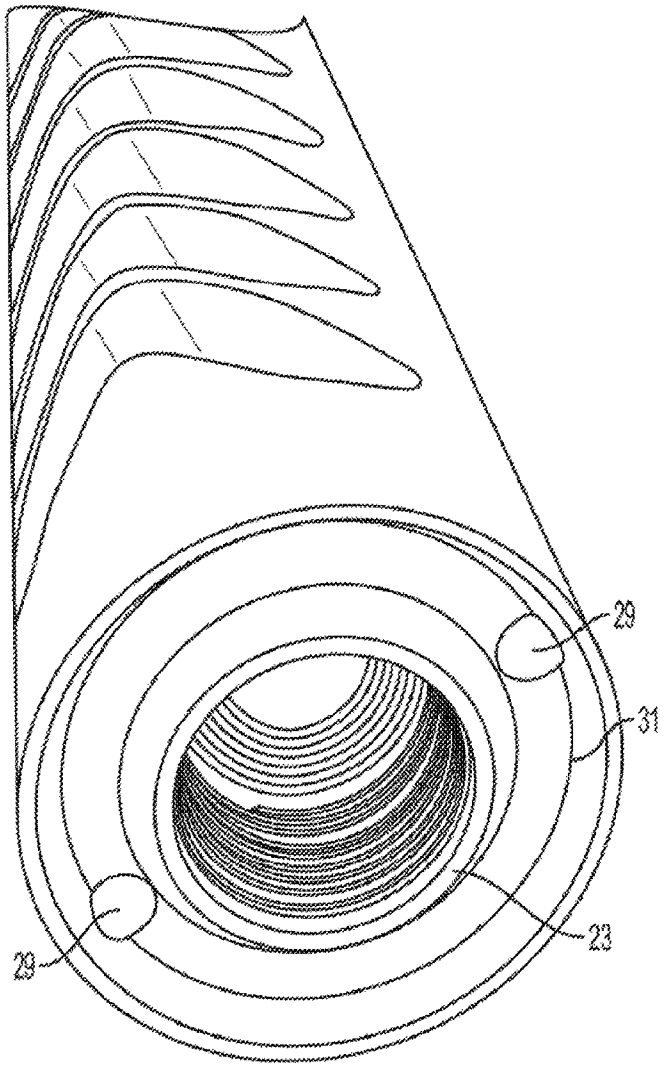
FIG. 5 is a perspective view of the distal end of the elongate member of the invention.

FIG. 5 is an end view of the elongate member 11 shown without the end cap 33 attached, further illustrating the discharge openings 29 which connect to channels 27. Also shown is the recessed region 31 of the elongate member 11 and silencer 101 of the invention which allows expansion and slowing of gases passing into the recessed region 31. Threads 23 shown thereon serve to secure the end cap 33 to the end of the elongate member 11 by engaging the threaded section 23.

Figure 6:
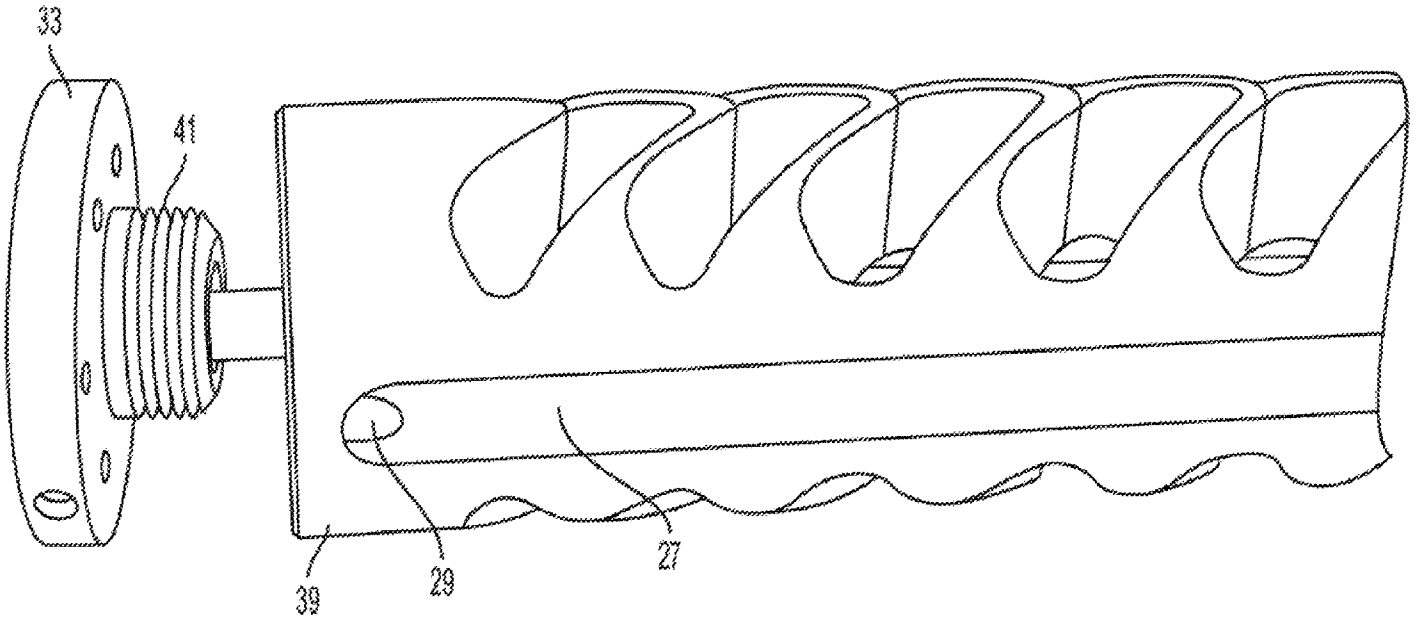
FIG. 6 is a disassembled view of the end cap and elongate member of the invention showing how the end cap is assembled onto the elongate member, but shown only in relation to the elongate member without the outer tube shown.

FIG. 6 illustrates how the end cap 33 is screwed onto the elongate member 11 through threads 23 of the end cap 33. For ease of understanding, the outer tube 43 which seals the elongate member 11 is not shown assembled thereon, but its assembly is readily apparent from this description: The channels 27 lead into openings 29 in a partial wall 39 to allow gases to pass out into recessed region 31.

Figure 7:
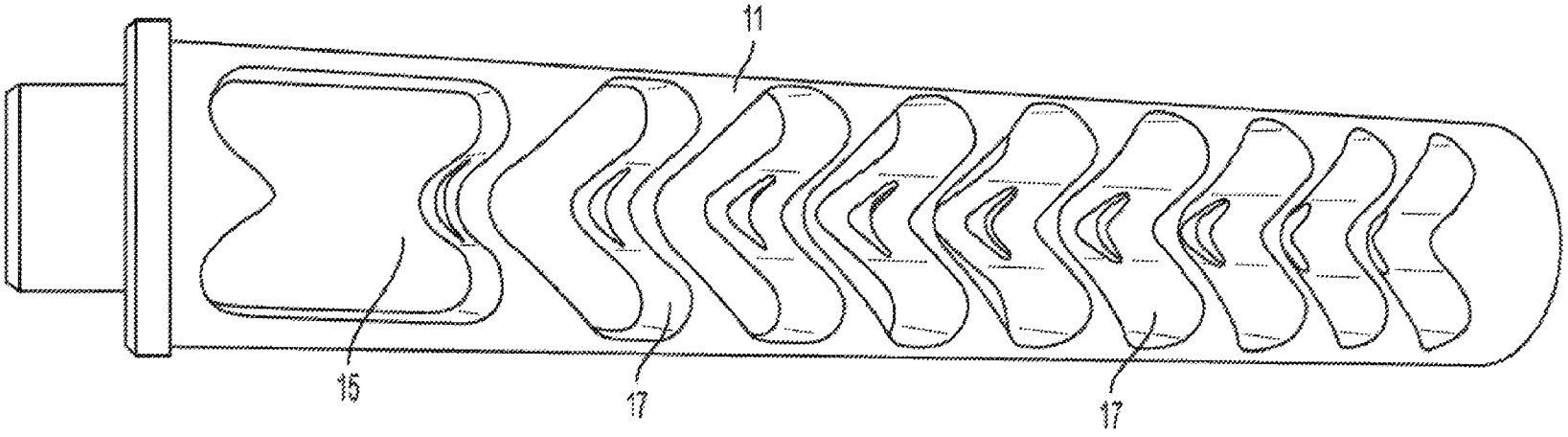
FIG. 7 is another side-view of the elongate member of the invention.

FIG. 7 is another view illustrating the elongate member 11 used in accordance with the invention and showing the increasingly smaller baffle chambers 17 in progression toward the distal end 19 of the elongate member 11, with the larger initial expansion chamber 15 at the end proximate the barrel of the firearm.

Figure 8:
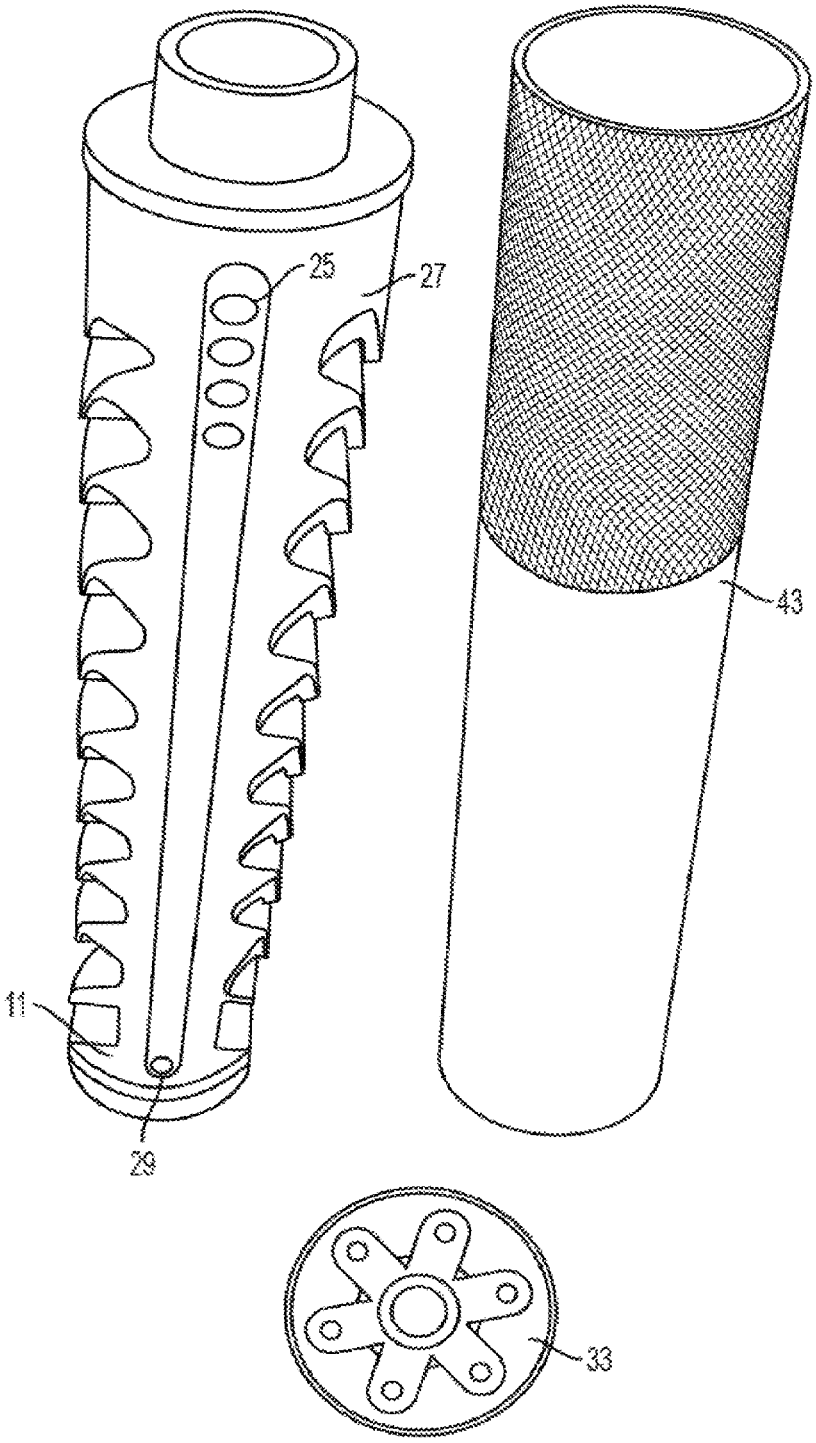
FIG. 8 is a disassembled view showing the elongate member of the invention, an end cap, and an outer tube used to complete the suppressor.

FIG. 8 illustrates the silencer 101 of the invention in disassembled form. When assembled, outer tube 43 fits over the elongate member 11 and seals the open baffle chambers 17, while at the same time allowing for gas to pass through outlet ports 25 in the elongate member 11 at the initial expansion chamber 15 and into channels 27 to be discharged out the distal end 19 of the silencer 101. The assembly is held together by passing the outer tube 43 over the elongate member 11. The outer tube 43 is held securely on the elongate member 11 by end cap 33 which is threaded into the threaded opening 29 at distal end 19 of the elongate member 11.

Figure 9:
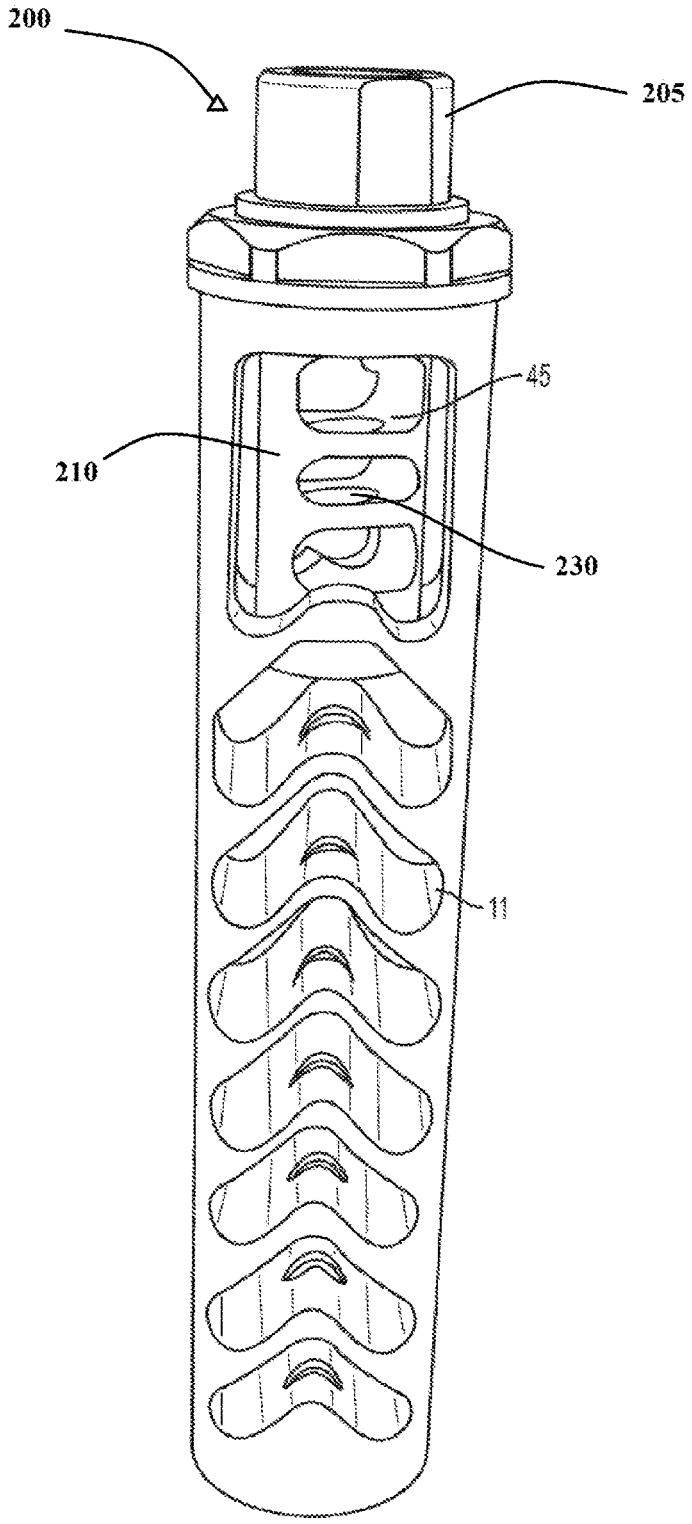
FIG. 9 is a perspective view showing an alternative embodiment of the elongate member of the invention and the muzzle mount, showing the front housing of the muzzle mount being received into the initial expansion chamber of the elongate member when assembled thereon.
Figure 10:
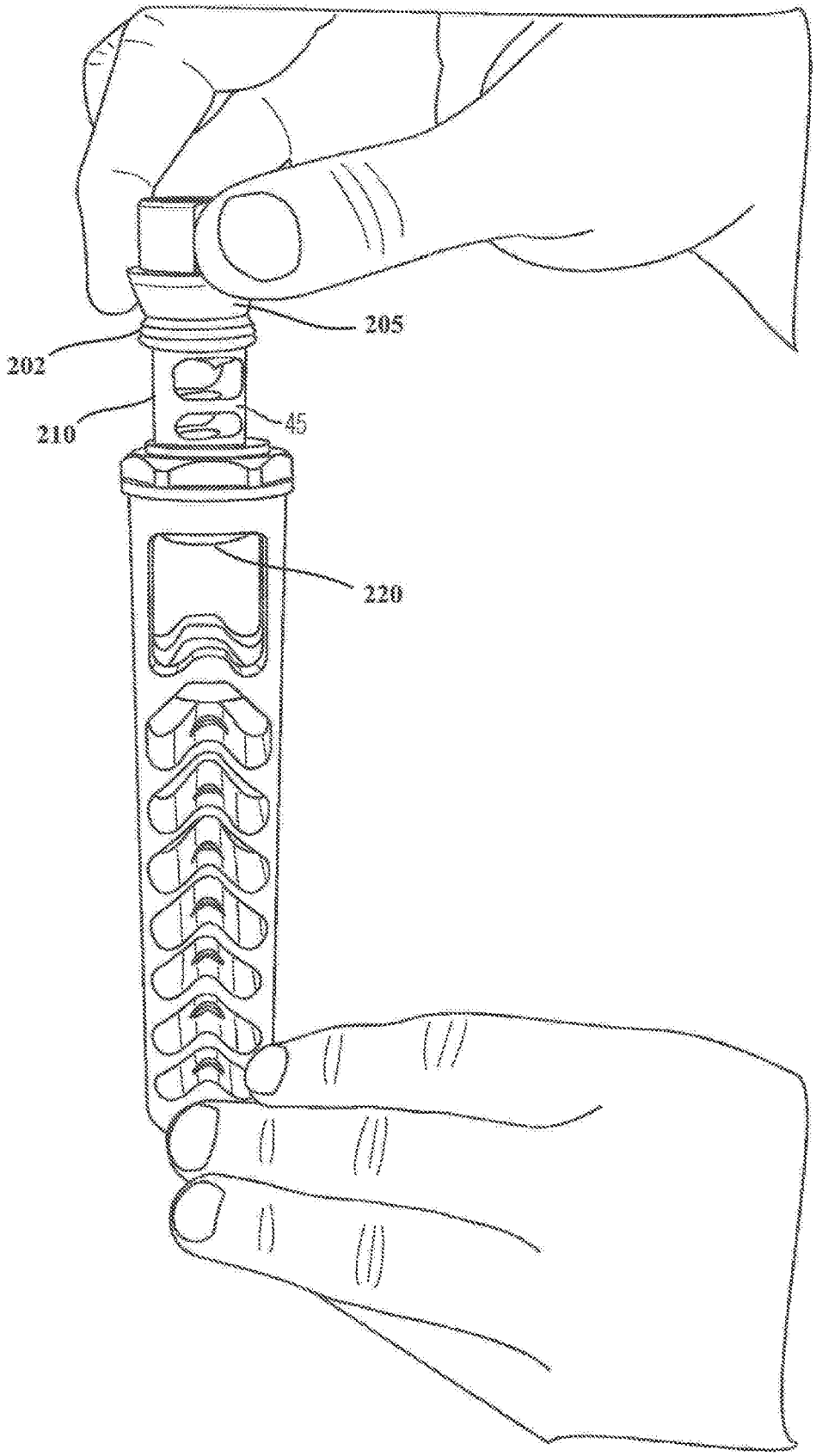
FIG. 10 is a side view showing an alternative embodiment of the elongate member of the invention and the front housing of the muzzle mount being inserted into the initial expansion chamber of the elongate member.
Figure 13:
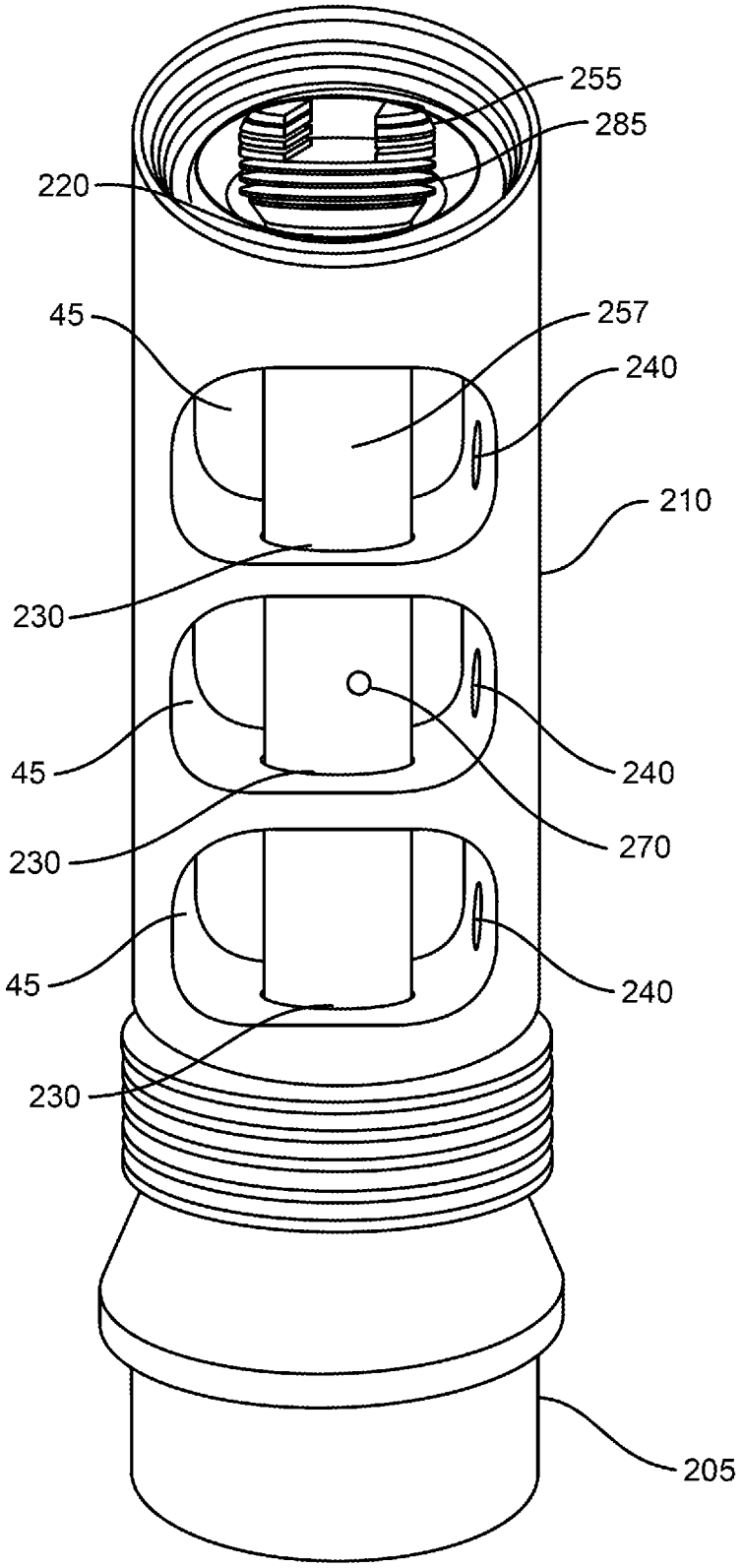
FIG. 13 is a perspective side view of the muzzle mount of the invention showing the blank firing adaptor threaded into front housing of the muzzle mount.
Figure 14:
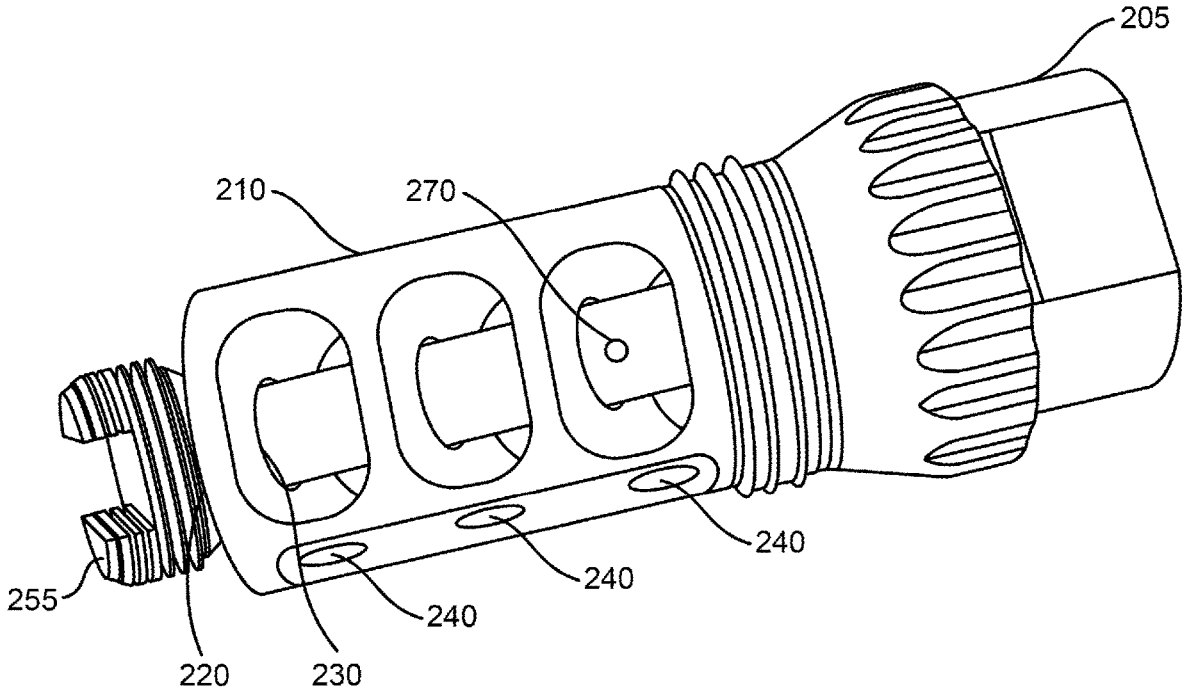
FIG. 14 is an alternative perspective side view of the muzzle mount of the invention showing the blank firing adaptor threaded into the front housing of the muzzle mount.
Figure 15:
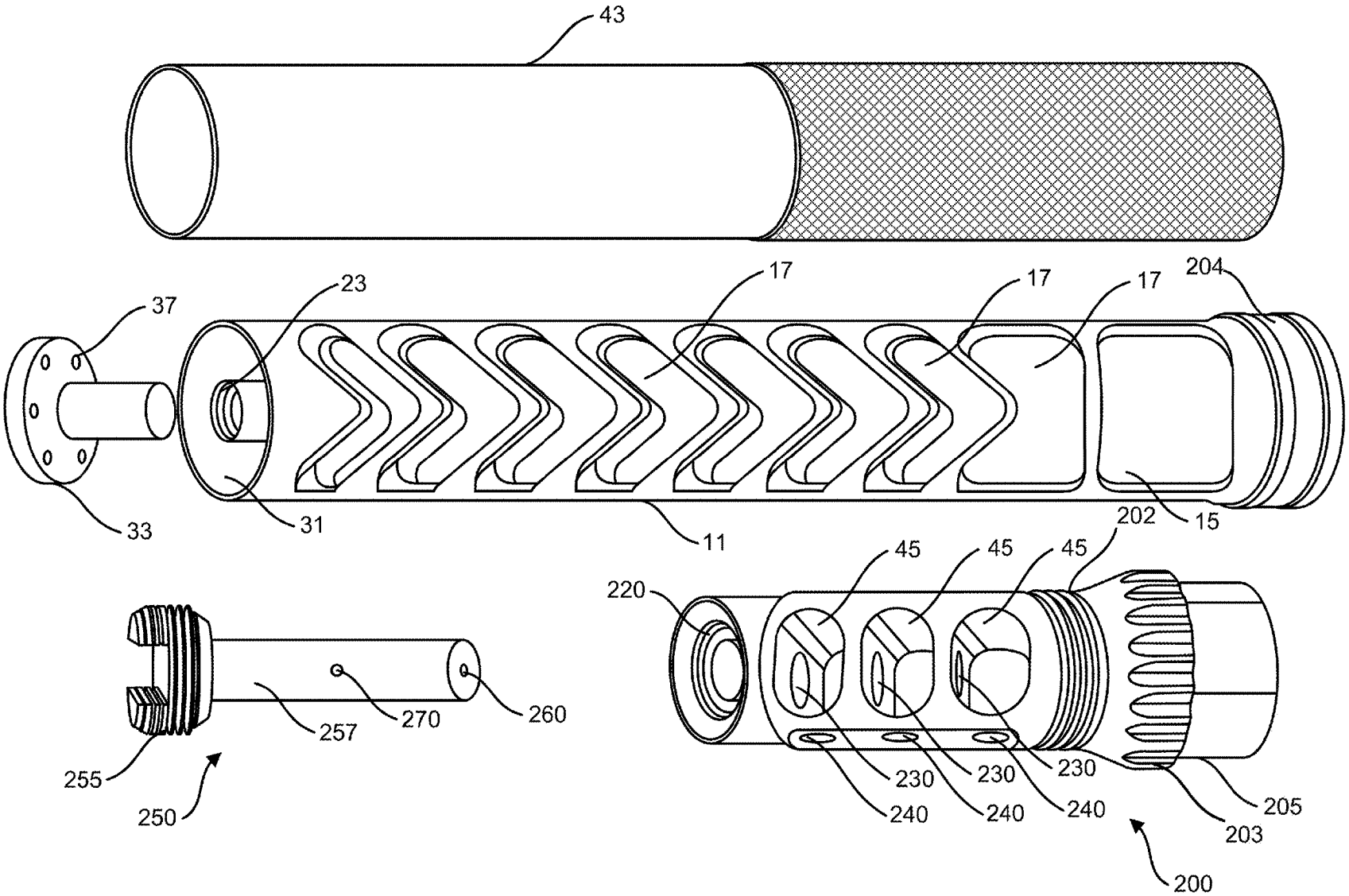
FIG. 15 is a disassembled view of the suppressor assembly showing the muzzle mount, blank firing adaptor, elongate member, end cap, and an outer tube.

In a yet still further embodiment illustrated in FIGS. 9 and 10, a muzzle mount 200 having a base 205 and a front housing 210 extending longitudinally from the base 205 is shown. The base 205 is operable to attach to the barrel of a firearm, for example, by threaded engagement. The front housing 210 of the muzzle mount 200 further includes an open front end 220 (as shown in FIG. 15) in communication with a central passage 230 disposed within the front housing 210, wherein the central passage 230 is aligned with the bore 21 of the elongate member 11. Optionally, the front housing 210 further includes one or more baffle chambers 45 as well as additional relief ports 240 disposed within the front housing 210 (as shown in FIGS. 13-14)

Turning to FIG. 10, the initial expansion chamber 15 of the elongate member 11 is operable to receive the front housing 210 of the muzzle mount 200. These additional baffle chambers 45 provide further suppression of firearm kick when fired. Further, it is well known that the force of the propellant gas on these baffle chambers is greatest at the outset and slowly dissipates as it travels through the plurality of baffle chambers, resulting in a greater amount of damage caused to the initial baffles. This configuration allows the additional baffle chambers 45 to be replaced over time when it wears out without having to replace the entire silencer 101.

Figure 11:
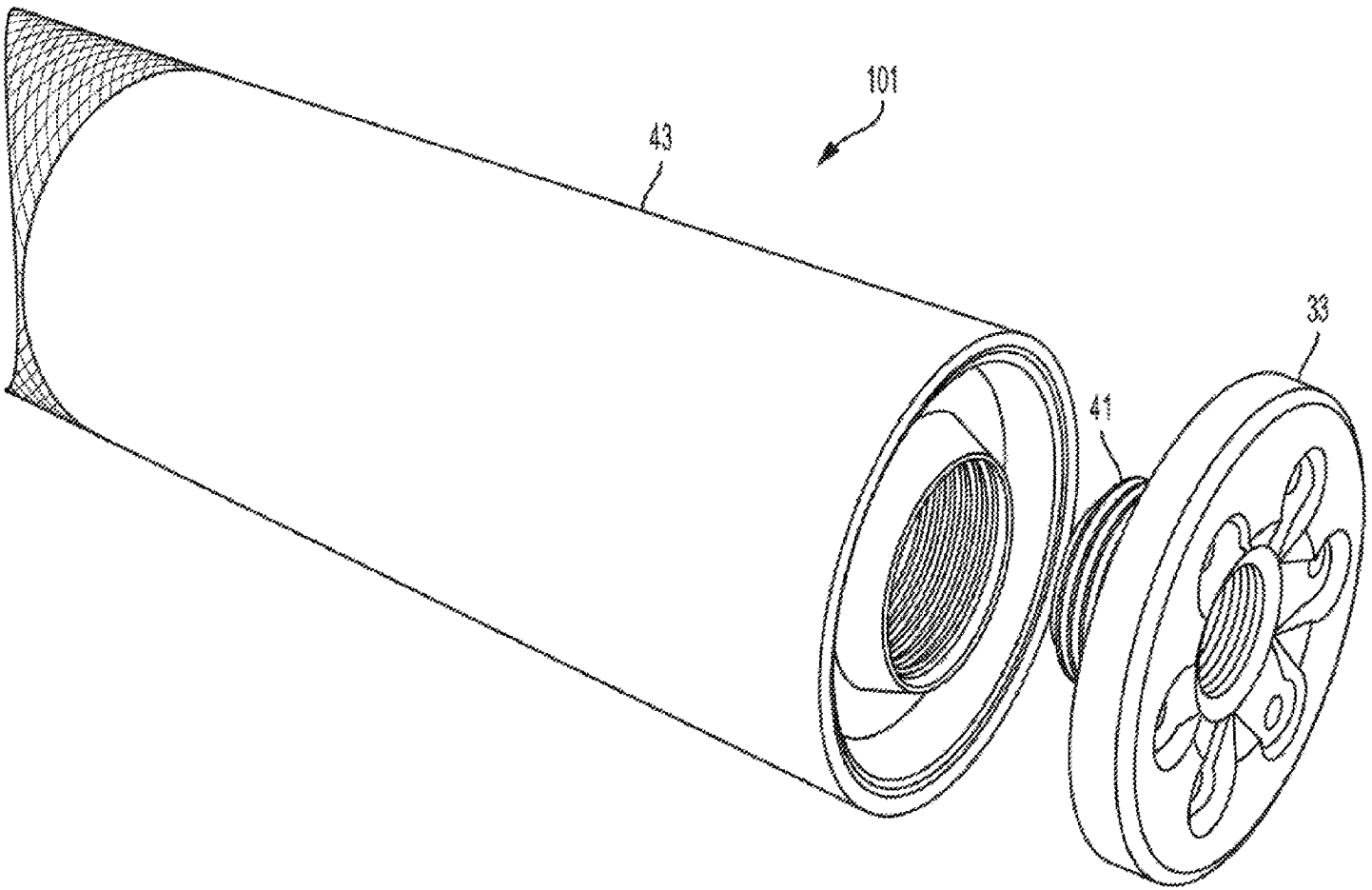
FIG. 11 is a perspective view of a partially assembled silencer with the end cap removed showing how the end cap is screwed on to hold the outer tube on the elongate member.

FIG. 11 illustrates how the end cap 33 holds the outer tube 43 on the elongate member 11 by engagement through threaded section 41.

Turning to FIGS. 12-16, the embodiments of the suppressor 101 are operable to include a blank firing adaptor 250 to form a suppressor assembly, the components of which are described in detail in FIG. 15. In this embodiment, it is anticipated that the base 205 of the muzzle mount 200 is fastened to the proximal end of the elongate member 11 by engaging the threads 202 on the muzzle mount with the proximal end of the elongate member 11 and further ratcheting the base 205 into proper alignment using a detent ball bearing and spring system acting in combination with the machined ridges 203 on the outer surface of the base 205. Here, the proximal end of the elongate member 11 includes a circumferential groove 204 as well as a plurality of holes operable to hold detent balls (not shown), which are held in place by the spring (not shown) secured around the groove 204.

Figure 12:
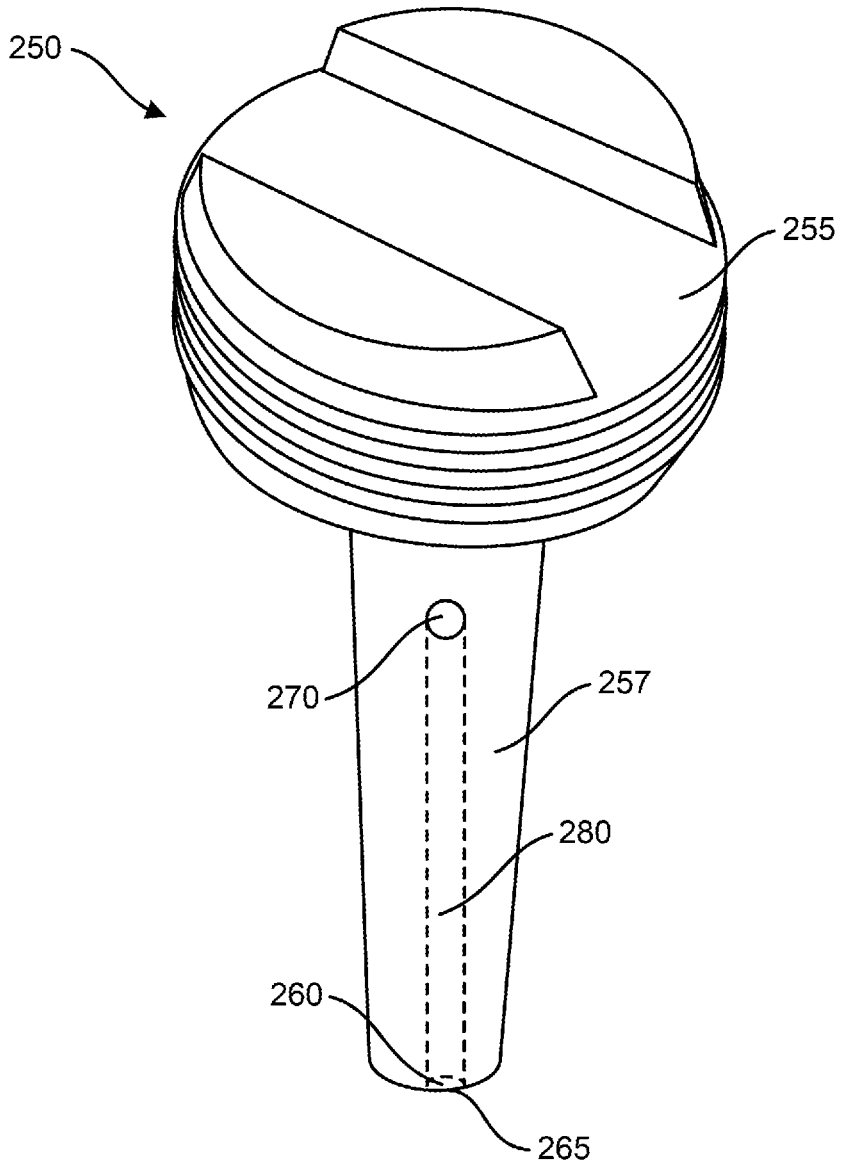
FIG. 12 is a perspective view of the blank firing adaptor of the invention.

Turning to FIG. 12, the blank firing adaptor 250 primarily includes a head 255 attached to a stem 257, wherein the stem 257 further includes an opening 260 that communicates with a relief port 270 via a central passage 280 within the stem, which is show in the figure using dashed lines.

Turning to FIGS. 13 and 14, the stem is sized and dimensioned to fit within the central passage 230 of the front housing 210 of the muzzle mount 200. The head 255 of the blank firing adaptor 250 is operable to be sealably fastened to the open front end 220 of the muzzle mount 200. As shown in FIGS. 12-16, the head 255 may include threads 285 that are operable to fasten the head 255 into a female threaded portion within the open front end 220 of the muzzle mount 200. The secure seal prevents any fragments or potential live rounds from being discharged while using the blank firing adaptor 250 in accordance with industry standards.

Figure 16:
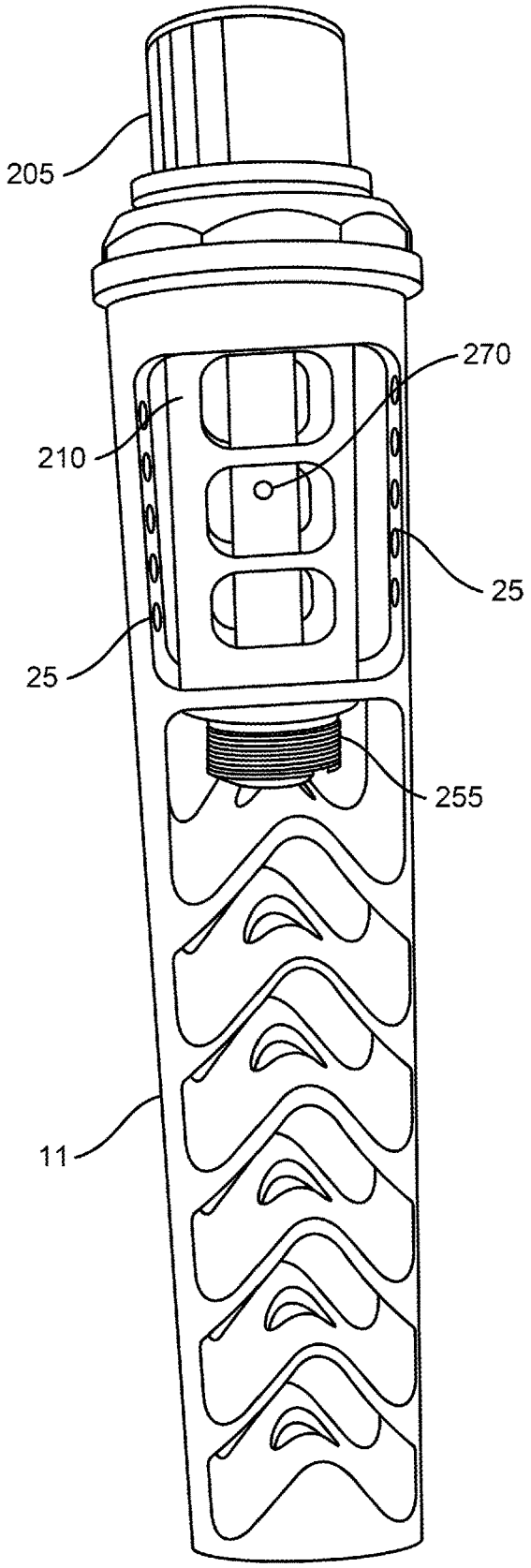
FIG. 16 is a view of a partially assembled suppressor assembly showing the blank firing adaptor secured to the muzzle mount and the muzzle mount secured to the elongate member without the outer tube and end cap.

The combination of the blank firing adaptor 250 and muzzle mount 200 may be used independently where the base 205 is fastened to the barrel of a firearm, or alternatively, the combination may be used in connection with the suppressor 101, i.e. the elongate member 11, end cap 33, and outer tube 43, as shown in detail in FIGS. 15 and 16. In order for the firearm to properly cycle while using the blank firing adaptor 250, there must be an outlet for propellant gas to be disbursed. The disclosed suppressor assembly is particularly suited to allow the firearm to cycle even while using the suppressor 101. As shown in FIG. 16, when the suppressor assembly is fully assembled, the relief port 270 of the blank firing adaptor 250 is positioned within the initial expansion chamber 15 of the muzzle mount 200. As set forth previously, any propellant gas passing through the blank firing adaptor 250 and exiting its relief port 270 will consequently be directed through the outlet ports 25 in the walls of the initial expansion chamber 15, down the recessed channels 27, through the discharge openings 29 and ultimately exit the firearm through the end cap openings 37.

Figure 17:
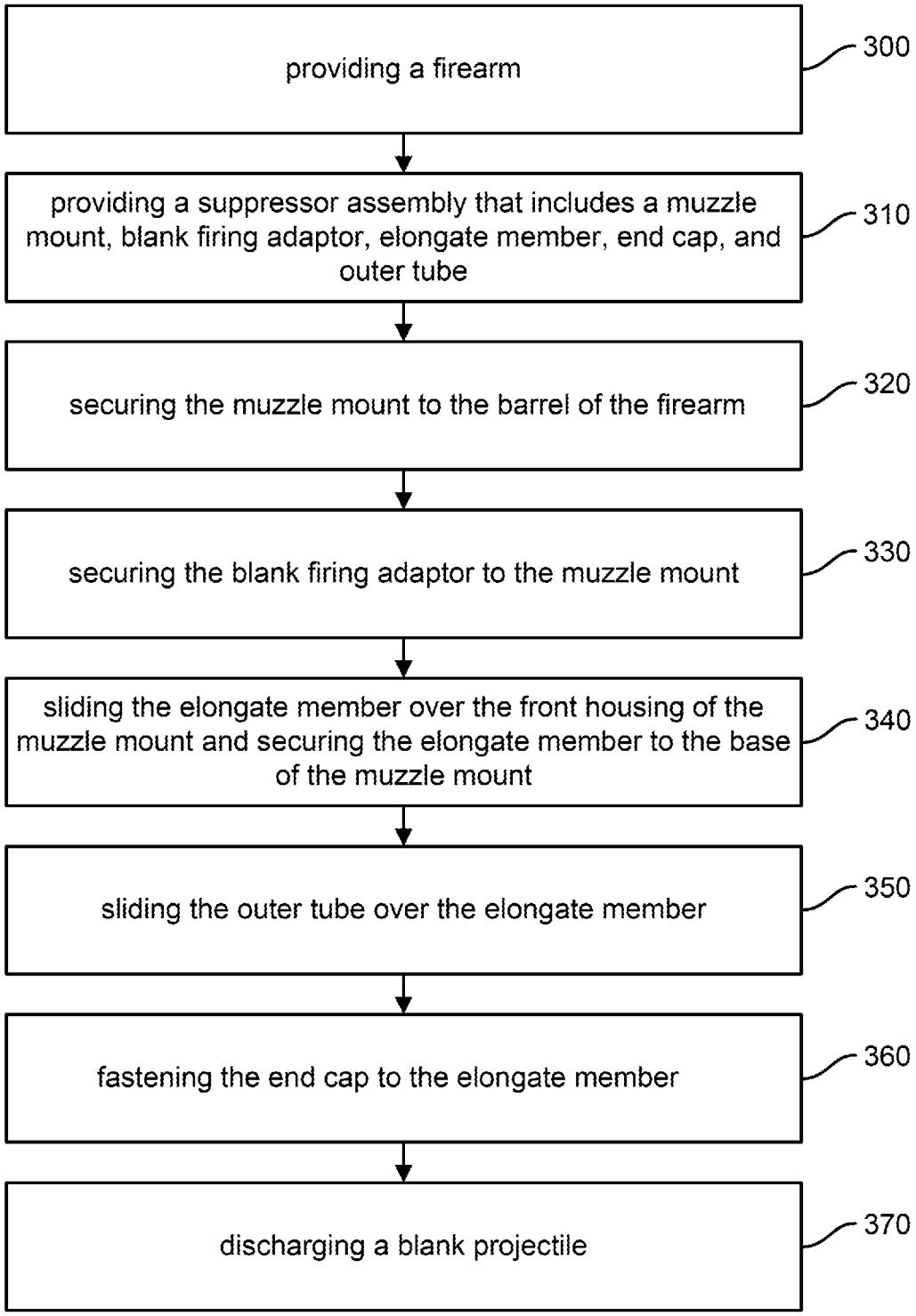
FIG. 17 is a flow diagram illustrating a method for utilizing the disclosed suppressor assembly to fire a blank projectile.

A further embodiment of the invention includes the method for firing blank projectiles using the suppressor assembly disclosed herein. Turning to FIG. 17, a flow diagram describing the steps of the method are shown. The first step 300 of the method includes providing a firearm. The second step 310 includes providing a suppressor assembly, including the blank firing adaptor 250, as disclosed in this patent application. The third step 320 requires the attachment of the base 205 of the muzzle mount 200 to the barrel of the firearm. The fourth step 330 includes fastening the blank firing adaptor 250 to the front housing 210 of the muzzle mount 200, by for example, threading the head 255 of the blank firing adaptor 250 through the threaded portion of the open front end 220 of the muzzle mount 200. After the blank firing adaptor 250 is secured to the muzzle mount 200, the fifth step 340 includes sliding the elongate member 11 over the front housing 210 of the muzzle mount 200 and securing the proximal end of the elongate member to the base 205 of the muzzle mount. The next step 350 includes sliding the outer tube 43 over the elongate member 11. In order to secure the outer tube 43 in place, the next step 360 includes fastening the end cap 33 to the distal end, preferably through engagement of the threads 23 at the distal end of the elongate member 11. After the components of the suppressor assembly have been properly secured, the final step 370 in the method allows a blank projectile to be fired wherein propellant gas associated with the projectile exits the blank firing adaptor at the relief port 270 and is redirected directed through the outlet ports 25 in the walls of the initial expansion chamber 15, down the recessed channels 27, through the discharge openings 29 and ultimately exit the firearm through the end cap openings 37.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A firearm suppressor assembly comprising:

a. a muzzle mount further comprising a base and a front housing extending longitudinally from the base, wherein said base is operable to attach to a firearm, and wherein the front housing further comprises an open front end, a baffle chamber disposed within the front housing, and a plurality of relief ports that communicates with the baffle chamber;

b. an elongate member comprising a top wall and a bottom wall extending from a proximal end of the elongate member to an opposing distal end, each having an outer surface and an inner surface, wherein a plurality of barriers connected to the inner surface of the top and bottom wall define an initial expansion chamber and a plurality of baffle chambers within the elongate member, wherein the initial expansion chamber is operable to receive the front housing of the muzzle mount, wherein the proximal end of the elongate member is operable to attach to the muzzle mount;

c. an outer tube operable to enclose the elongate member;

d. an end cap, wherein the end cap is operable to attach to the distal end of the elongate member; and e. a blank firing adaptor comprising a stem attached to a head, wherein the stem is sized and dimensioned to fill the bore, wherein the head is operable to be fastened to the open front end of the muzzle mount, wherein a bore operable to receive a projectile extends longitudinally through the muzzle mount, elongate member, and end cap.

2. The firearm suppressor assembly of claim 1 wherein the head of the blank firing adaptor and the inner surface of the front housing of the muzzle mount are threaded to allow the blank firing adaptor to be securely fastened to the muzzle mount.

3. The firearm suppressor assembly of claim 1 further comprising at least one outlet port disposed within the initial expansion chamber, at least one discharge opening at the distal end of the elongate member, at least one opening along the perimeter of the end cap, and at least one recessed channel machined in the outer surface of the top or bottom wall and extending longitudinally along the length of the wall, wherein the port communicates with the discharge opening via the recessed channel, and wherein the discharge opening communicates with the opening of the end cap.

4. The firearm suppressor assembly of claim 1 wherein the distal end of the elongate member comprises a recessed region, such that an enclosed cavity is formed around the bore and between the distal end and the end cap.

5. The firearm suppressor assembly of claim 4 wherein one or more openings of the end cap communicate with the recessed region.

6. The firearm suppressor assembly of claim 1 wherein the end cap further comprises threads operable to fasten within the bore of the distal end of the elongate member.

7. The firearm suppressor assembly of claim 1 wherein the base of the muzzle mount is fastened to the proximal end of the elongate member using a detent ball bearing and spring system.

8. A firearm suppressor assembly for use with a blank firing adaptor, comprising:

a. a muzzle mount further comprising a base and a front housing extending longitudinally from the base, wherein said base is operable to attach to a firearm, and wherein the front housing further comprises an open front end, a baffle chamber disposed within the front housing, and a plurality of relief ports that communicates with the baffle chamber;

b. an elongate member comprising a top wall and a bottom wall extending from a proximal end of the elongate member to an opposing distal end, each having an outer surface and an inner surface, wherein a plurality of barriers connected to the inner surface of the top and bottom wall define an initial expansion chamber and a plurality of baffle chambers within the elongate member, wherein the initial expansion chamber is operable to receive the front housing of the muzzle mount, wherein the proximal end of the elongate member is operable to attach to the muzzle mount;

c. an outer tube operable to enclose the elongate member;

d. an end cap, wherein the end cap is operable to attach to the distal end of the elongate member, wherein a bore operable to receive a projectile extends longitudinally through the muzzle mount, elongate member, and end cap; and e. a blank firing adaptor comprising a stem attached to a head, wherein the stem is sized and dimensioned to fill the bore, wherein the head is operable to be fastened to the open front end of the muzzle mount.

9. The firearm suppressor assembly of claim 8 wherein the head of the blank firing adaptor and the inner surface of the front housing of the muzzle mount are threaded to allow the blank firing adaptor to be securely fastened to the muzzle mount.

10. The firearm suppressor assembly of claim 8 further comprising at least one port disposed within a portion of the outer wall defining the initial expansion chamber, at least one discharge opening at the distal end of the elongate member, at least one opening along the perimeter of the end cap, and at least one recessed channel in the outer surface of the top or bottom wall extending longitudinally along the length of the wall, wherein the port communicates with the discharge opening via the recessed channel, and wherein the discharge opening communicates with the opening of the end cap.

11. The firearm suppressor assembly of claim 8 wherein the distal end of the elongate member comprises a recessed region, such that an enclosed cavity is formed around the bore and between the distal end and the end cap.

12. The firearm suppressor assembly of claim 11 wherein one or more openings of the end cap communicate with the recessed region.

13. The firearm suppressor assembly of claim 8 wherein the end cap further comprises a stem that is sized and dimensioned to fit within the bore at the distal end of the elongate member.

14. The firearm suppressor assembly of claim 13 wherein the stem of the end cap and the bore disposed within the distal end of the elongate member are threaded to allow the end cap to be fastened to the distal end of the elongate member.

15. The firearm suppressor assembly of claim 1 wherein the base of the muzzle mount is fastened to the proximal end of the elongate member using a detent ball bearing and spring system.

16. A method for firing blank projectiles while using a suppressor, said method comprising the steps of:

f. providing a firearm;

g. providing a firearm suppressor assembly comprising;

a muzzle mount further comprising a base and a front housing extending longitudinally from the base, wherein said base is operable to attach to the firearm, and wherein the front housing further comprises an open front end, a baffle chamber disposed within the front housing, and a plurality of relief ports that communicates with the baffle chamber;

an elongate member comprising a top wall and a bottom wall extending from a proximal end of the elongate member to an opposing distal end, each having an outer surface and an inner surface, wherein a plurality of barriers connected to the inner surface of the top and bottom wall define an initial expansion chamber and a plurality of baffle chambers within the elongate member, wherein the initial expansion chamber is operable to receive the front housing of the muzzle mount, wherein the proximal end of the elongate member is operable to attach to the muzzle mount;

an outer tube operable to enclose the elongate member; and an end cap, wherein the end cap is operable to attach to the distal end of the elongate member, wherein a bore operable to receive a projectile extends longitudinally through the muzzle mount, elongate member, and end cap;

h. providing a blank firing adaptor comprising a stem attached to a head, wherein the stem is sized and dimensioned to fill the bore, wherein the head is operable to be fastened to the open front end of the muzzle mount;

i. attaching the base of the muzzle mount to the barrel of the firearm;

j. fastening the blank firing adaptor to the front housing of the muzzle mount;

k. sliding the elongate member over the front housing of the muzzle mount;

l. sliding the outer tube over the elongate member;

m. fastening the end cap to the second end of the elongate member; and n. discharging a blank projectile through the firearm.

* * * * *